United States Patent [19]

Harvey

[11] 4,307,317

[45] Dec. 22, 1981

[54] BIPOLAR CROSSED-FIELD DEVICE INCLUDING ELECTROMAGNETIC COILS OF THE SAME POLARITY

[75] Inventor: Robin J. Harvey, Thousand Oaks, Calif.

[73] Assignee: Hughes Aircraft Company, Culver City, Calif.

[21] Appl. No.: 85,577

[22] Filed: Oct. 17, 1979

[51] Int. Cl.[3] ..... H01J 1/50; H01J 23/10

[52] U.S. Cl. ..... 313/154; 313/156

[58] Field of Search ..... 313/154, 156

[56] References Cited

U.S. PATENT DOCUMENTS 3,215,893 11/1965 Boucher et al. ..... 313/156 X 3,906,270 9/1975 Gallagher et al. ..... 313/157

FOREIGN PATENT DOCUMENTS 88941 4/1967 France ..... 313/154

OTHER PUBLICATIONS

Inoue et al., Japanese Journal of Applied Physics, vol. 10, No. 2, (Feb. 1971), Blocking of Plasma Stream by Transverse Magnetic Field, pp. 243–247.

*Primary Examiner*—Robert Segal

*Attorney, Agent, or Firm*—Allen A. Dicke, Jr.; W. H. MacAllister

[57] ABSTRACT

Bipolar crossed-field device 10 has outer electrode 12 and inner electrode 18 which define interelectrode space 16. Magnetic field coils 46, 48 operate together to form a magnetic field in the interelectrode space 16 shaped to trap electrons for cascading ionization and plasma formation when viewed from either electrode.

1 Claim, 4 Drawing Figures

BIPOLAR CROSSED-FIELD DEVICE INCLUDING ELECTROMAGNETIC COILS OF THE SAME POLARITY

BACKGROUND

This invention is directed to a bipolar crossed-field switch device wherein potential may be applied in either direction for on-switching, or current can flow in either direction for off-switching of the switch device.

R. J. Harvey, U.S. Pat. No. 4,071,801 describes a crossed-field switch device having a single interelectrode space or gap, with control of the magnetic field causing off-switching. That patent describes an improvement over the general background. H. E. Gallagher and Wolfgang Knauer are inventors of U.S. Pat. No. 3,906,270 and U.S. Pat. No. 3,963,960. Both of these are directed to bipolar structures. Gallagher and Knauer, U.S. Pat. No. 3,906,270 describes a single gap crossed-field switch device wherein the magnetic field is shaped to provide for substantially uniform conduction in either polarity. That patent also identifies the early prior art in crossed magnetic and electric field devices, such as those in the Penning U.S. Pat. No. 2,182,736 & Boucher U.S. Pat. Nos. 3,215,893 and 3,215,939. On the other hand, Gallagher and Knauer, U.S. Pat. No. 3,963,960 is directed to a two interelectrode gap device, one having three electrodes, and it identifies in its background the G. A. G. Hofmann et al., U.S. Pat. No. 3,641,384 patent which has a three electrode structure with two interelectrode spaces. The R. J. Harvey and the two Gallagher and Knauer U.S. patents identified above are incorporated herein in their entirety, including their background references, by this reference.

These patents point up the difficulty of providing a structure wherein the physical process produces the plasma with sufficient uniformity in each direction that bipolar on-switching, conduction and off-switching can be achieved. Such is necessary where the crossed-field switch device is applied in an alternating current circuit, particularly a high speed circuit which can be actuated in a fraction of a cycle. Such structures are necessary for increasing the impedence in faulted alternating current high voltage lines.

SUMMARY

In order to aid in the understanding of this invention it can be stated in essentially summary form that it is directed to a bipolar crossed-field switch device having a single interelectrode space or gap and having the magnetic field in the gap shaped so that the crossed-field switch device can conduct in either polarity with substantially the same voltage drop.

It is thus an object of this invention to provide a bipolar crossed-field switch device which can conduct in either polarity with substantially the same voltage drop. It is a further object to provide a bipolar crossed-field switch device which is capable of being inserted into an alternating current circuit for conduction in either polarity and for off-switching during the conduction half-cycle so as to insert impedence into the alternating current circuit within the half-cycle. It is a further object to shape the magnetic field in the interelectrode space of a crossed-field switch device so that the magnetic field lines in the space permit sustained plasma ionization for continued conduction, until off-switching is desired. It is a further object to provide a magnetic field geometry so that the interelectrode space in the crossed-field switch device has regions of both negative and positive curvature for trapping of electrons in either polarity.

Other objects and advantages of this invention will become apparent from a study of the following portion of the specification, the claims and the attached drawings.

DESCRIPTION OF THE PREFERRED EMBODIMENT

Figure 1:
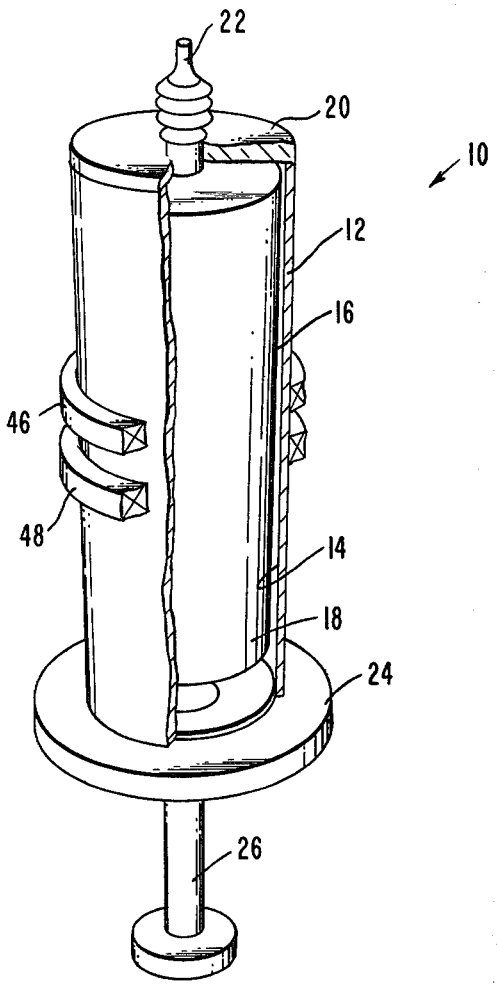
FIG. 1 is a perspective view, with parts broken away, of the bipolar crossed-field switch device of this invention.

The bipolar crossed-field switch device of this invention is generally indicated at 10 in FIG. 1. It has a housing 12 which serves as a vacuum envelope and as the outerelectrode. The inner surface 14 serves as the outer boundary of interelectrode gap, or space, 16. Inner electrode 18 faces gap 16 to further define the gap. In the usual structure the electrodes are cylindrical and define an annular gap. Inner electrode 18 is connected through top cap 20 to conductor 22. Outer electrode 12 is mounted on base flange 24. Foot 26 serves as the electrical connector for outer electrode 12.

Figure 2:
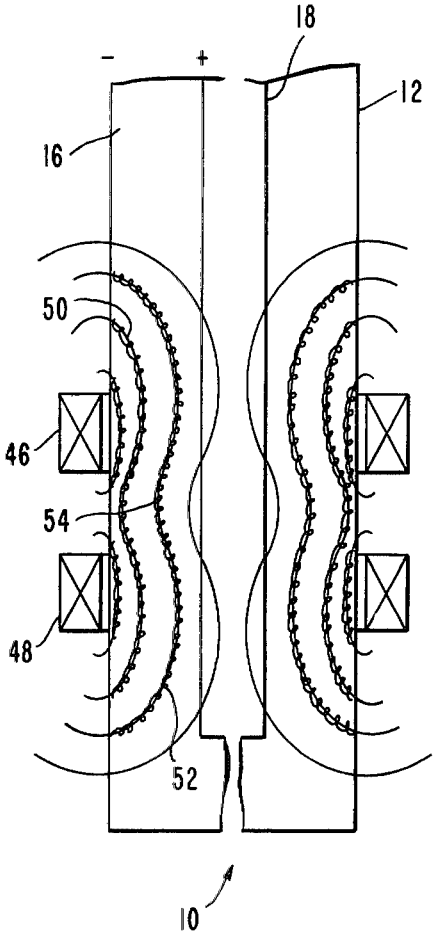
FIGS. 2 and 3 are each a longitudinal section through a bipolar crossed-field switch device in accordance with this invention, with parts broken away, showing the electron paths in the two different polarities of conduction.

In a conventional prior art structure a magnetic coil develops a curved field in the interelectrode space, see FIG. 2 in U.S. Pat. No. 3,906,270 and FIGS. 2 and 4 in U.S. Pat. No. 3,963,960. The usual prior art has a magnetic field coil such is found in R. J. Harvey U.S. Pat. No. 4,071,801, described above.

A crossed-field switch device has potential applied between the electrodes and has a specific gas at specific pressure in the interelectrode space. The dimensions and gas pressure are such that in the absence of the magnetic field, any electrons which leave the cathode surface continue to the anode without a sufficient chance of collision to cause self-sustained, cascading ionization. When a magnetic field of the proper strength and shape is applied, then the electron paths are sufficiently long that collisions take place to form a self-maintained plasma as a result of the cascading ionization. In the case of prior art structure, electrons leaving the cathode spiral along the magnetic field lines to produce cascading ionization. The curvature of the lines is negative when viewed from the cathode, that is they intersect the cathode pass through the interelectrode space and return to the cathode, so that the electrons trapped by the magnetic lines of force cannot directly reach anode by spiraling along the lines. It is this trapping of the electrons away from the anode (where they would be lost) that causes the sustained ionization of the plasma.

This should be compared to the reverse polarity conditions applied to a conventional crossed-field switch device where the inner electrode is negative and the outer electrode is positive. In this case, electrons leaving the cathode and spiraling around the magnetic field lines, are not trapped but continue directly to the anode where they are captured. The length of the electron path is not sufficient to cause self-sustained cascading ionization and thus the self-maintained plasma is not formed and conduction (other than the conduction by the occasional electron loss from the cathode) does not take place.

Figure 3:
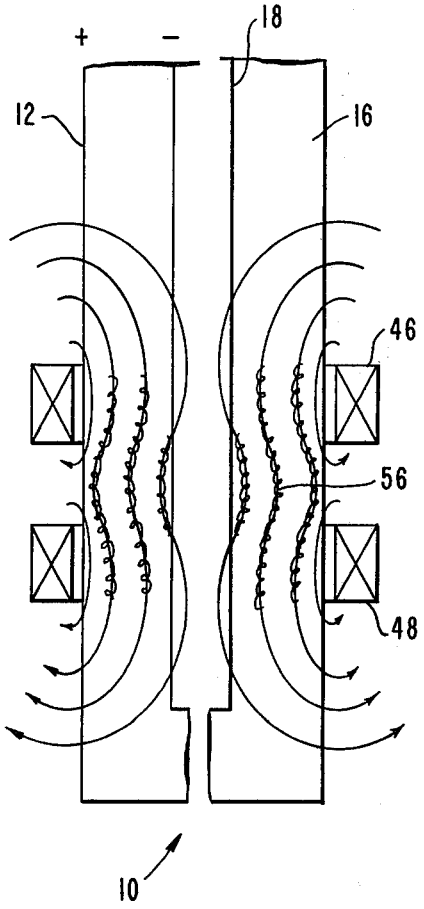

Bipolar crossed-field switch device 10 in accordance with this invention has magnetic field coils exterior to the interelectrode space which shape the magnetic field in the interelectrode space so that there is positive and negative curvature to the magnetic field lines when viewed from either electrode. In the present instance, magnetic field coils 46 and 48 are outside of housing 12 and act together to produce the magnetic field in the interelectrode gap space 16. The magnetic field coils 46 and 48 are wound and connected so that the fields of the two coils are aiding, as seen in FIGS. 2 and 3. The magnetic fields in the interelectrode space 16 are such that there is negative curvature in the magnetic field lines, such as at the regions 50 and 52 in FIG. 2 so that when the outer electrode 12 is negative to act as a cathode as in FIG. 2, electrons are trapped in the regions of negative curvature so as to produce the cascading ionization which produces the plasma in the interelectrode space by which the crossed-field switch device conducts. Furthermore, there is region 54 of positive curvature when seen from cathode 12 in FIG. 2 which appears as a region 56 of negative curvature from the cathode when inner electrode 18 is made negative to act as a cathode as shown in FIG. 3. In that case, electrons are trapped in the region 56 of negative curvature so that electron trapping and cascading ionization which produces plasma takes place.

Figure 4:
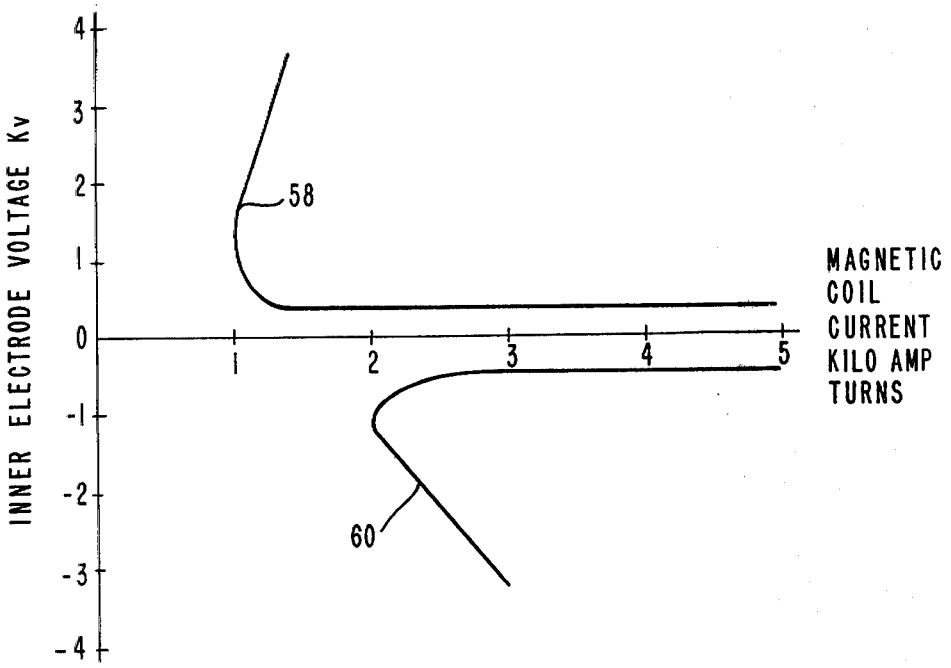
FIG. 4 is a graph showing in solid lines the conduction conditions for the bipolar crossed-field switch device of this invention of FIGS. 1, 2 and 3.

FIG. 4 illustrates at its ordinate the voltage of the innerelectrode with respect to the outer electrode in kilo-volts. The strength of the magnetic field is shown on the abscissa as the magnetic coil current in kilo-ampere turns. These figures are valid for a crossed-field switch device having an interelectrode gap of about 1 centimeter, an inner electrode diameter of 10 centimeters, and a useful axial gap length of 5 centimeters which is filled with helium gas at 50 millitorr.

As seen in FIG. 4, curve 58 illustrates within its knee the conductive range of conditions for the situation of FIG. 2 where the outer electrode is negative with respect to the inner electrode. It also shows curve 60 of the region of conductive conditions for the situation of FIG. 3 wherein the inner electrode 18 is negative. The regions embraced by the curves 58 and 60 are not symmetrical about the abscissa because the regions of electron trapping in the two polarities are not the same. However, by suitable adjustment of the magnetic field, by the use of a plurality of magnets and magnetic field guides outside of the interelectrode space and outside of the outer electrode trapping regions can be produced for each polarity which are equally effective so that the conductive conditions are substantially the same. In this way, a bipolar crossed-field switch device is provided which can conduct and off-switch in either polarity and with a sufficiently uniform voltage drop in either polarity to be useful as a bipolar structure.

This invention has been described in its presently contemplated best mode and it is clear that it is susceptible to numerous modifications, modes and embodiments within the ability of those skilled in the art and without the exercise of the inventive faculty. Accordingly, the scope of this invention is defined by the scope of the following claims.

I claim:

1. A bipolar crossed-field switch device comprising:

first and second spaced electrodes defining an interelectrode space therebetween, said electrodes being cylindrical and said interelectrode gap being annular, said first electrode being the outer electrode and said second electrode being the inner electrode, said electrodes being shaped so that said space is a continuous closed annular path;

means for enclosing said space so that a selected gas in an amount insufficient for self-sustained cascading ionization in the presence of an electric field and in the absence of a magnetic field and in sufficient quantity so that ions therein ionize in the presence of the electric field and a magnetic field of proper strength and shape so that cascading ionization can be maintained therein;

first and second annular electromagnetic coils of the same polarity positioned exteriorly of said outer first electrode so that each said magnetic field coil produces a first region of negative curvature in said interelectrode space when viewed from said outer first electrode, and a second region of positive curvature in said interelectrode space therebetween, so that when a potential is applied to said electrodes with said first electrode negative, said first region of negative curvature can trap electrons to cause cascading ionization and the formation of conductive plasma in the interelectrode space and so that when a negative potential is applied to said second electrode, said second region of positive curvature in said interelectrode space when viewed from said first electrode causes trapping of electrons so that cascading ionization and the formation of an electrically conductive plasma occurs in the interelectrode space so that said crossed-field switch device is conductive in either polarity.

* * * * *